US006698632B1

(12) United States Patent
Turner, Jr. et al.

(10) Patent No.: US 6,698,632 B1
(45) Date of Patent: Mar. 2, 2004

(54) NAIL COIL AND TOOL HOLDING ASSEMBLY

(76) Inventors: William Turner, Jr., 5 Centerton, Parsippany, NJ (US) 07054; William Turner, Sr., 5 Centerton, Parsippany, NJ (US) 07054

( * ) Notice: Subject to any disclaimer, the term of this patent is extended or adjusted under 35 U.S.C. 154(b) by 23 days.

(21) Appl. No.: 10/237,295

(22) Filed: Sep. 9, 2002

(51) Int. Cl.[7] ..... A45F 5/00

(52) U.S. Cl. ..... 224/196; 224/197; 224/199; 224/236; 224/665; 224/666; 224/667; 224/682; 224/904

(58) Field of Search ..... 224/196, 197, 224/199, 232, 236, 269, 665, 666, 667, 682, 901.8, 904; 206/372, 815

(56) References Cited

U.S. PATENT DOCUMENTS

| | | | | | |
|---|---|---|---|---|---|
| 3,091,378 | A | * | 5/1963 | O'Dwyer | 224/682 |
| 3,668,802 | A | * | 6/1972 | Benward | 224/666 |
| D254,758 | S | * | 4/1980 | Rodstein | 224/904 |
| 4,932,576 | A | | 6/1990 | Ashley | 224/253 |
| 4,993,614 | A | * | 2/1991 | Bonofiglo | 224/665 |
| 5,388,742 | A | * | 2/1995 | Ethridge et al. | 224/666 |
| 5,505,356 | A | * | 4/1996 | Noriega et al. | 224/682 |
| 5,839,630 | A | * | 11/1998 | Dunstan et al. | 224/197 |
| 5,992,716 | A | * | 11/1999 | Riley | 224/197 |
| 6,213,365 | B1 | * | 4/2001 | Stocke et al. | 224/665 |
| 6,311,881 | B1 | * | 11/2001 | Kamiya | 224/269 |
| 6,390,348 | B1 | * | 5/2002 | Godshaw et al. | 224/904 |

* cited by examiner

*Primary Examiner*—Gary E. Elkins
(74) *Attorney, Agent, or Firm*—Goldstein Law Offices, P.C

(57) ABSTRACT

A nail coil and tool holding assembly, having a belt and a number of nail coil pouches each having a front and a rear. The rear of each pouch is attached to the belt by a single rivet. Pivotal attachment onto the belt by the rivet allows the pouches to be rotated to maximize ease of access to the nails. A hammer holder, a utility knife holder pouch, and a pencil holder pouch may be attached to the belt by means of fastening material attached to the rear surface of the belt. Each nail coil pouch has an open top lip and a vertical slot on the front surface, to facilitate easy access to the nails. The nail coils may be positioned in the nail coil pouch so that the points of the nails are oriented towards the pouch rear to minimize the risk of injury to the user.

8 Claims, 3 Drawing Sheets

NAIL COIL AND TOOL HOLDING ASSEMBLY

BACKGROUND OF THE INVENTION

1. Field of the Invention

The invention relates to a nail coil and tool holding assembly. More particularly, the invention has a belt which is worn around the waist of a user, has a plurality of nail coil pouches for holding nail coils, and which also selectively may be employed to hold a utility knife holder pouch, a pencil holder pouch, and/or a hammer holder.

2. Description of the Related Art

Carpenters and other tradesmen often need tools and other items at their ready disposal in order to avoid an additional trip to obtain these items. In particular, a roofer will often need to use many nails for a roofing job. Consequently, roofers often employ nail coils, each of which typically has 120 nails, which may be deployed with a pneumatic gun designed to hold one of the nail coils at a time. However, often more than the typical 120 nails present in a single coil are needed for a job. Especially when roofing, hundreds and perhaps even thousands of nails are required. Accordingly, the roofer must make frequent trips to replace an expended nail coil. However, movement upon a roof is extremely dangerous. Accordingly, each trip to obtain a new nail coil subjects the roofer to unnecessary risk.

In addition, various other tools are frequently necessary during a job, but must be obtained from another location when needed. "Utility belts" of various configurations have been devised in an attempt to provide a worker with commonly needed tools.

Some of these utility belts employ pouches of various configurations to store specific items which fulfill a particular need and which may be used by various tradesmen. In this regard, U.S. Pat. No. 4,932,576 to Ashley shows a pouch assembly which includes a belt and one or more pouches attached thereon. However, with its closed sides, if one attempted to store nail coils therein, they would be difficult to remove without injury.

U.S. Pat. No. 5,388,742 to Ethridge et al. appears to show a nail coil rack comprised of a T-bar with a right angle bend, capable of being supported by a worker's belt. However, Ethridge positions the nail coil in a manner which may easily result in injuries to the user by the sharp ends of the nails when attempting to retrieve the nail coil.

In general, the storage of nail coils in currently available pouches results in injuries since the nail coils are positioned such that it is not easy to grasp the nail coil without exposing the fingers to the sharp tips of the nails. For example, when numerous coils are "dumped" in a large pouch, they becomes randomly arranged therein. Accordingly, when the worker blindly reaches into the pouch, there is a high probability that the worker's fingers will first encounter the pointed end of a nail.

While the units described above may be suitable for the particular purpose employed, or for general use, they would not be as suitable for the purposes of the present invention as disclosed hereafter.

SUMMARY OF THE INVENTION

It is an object of the invention to provide a device which allows a worker to have within arm's reach all of the nails that may be needed to complete a particular job, without having to leave the work area to replenish the supply of nails. Accordingly, this device has a utility belt with a plurality of attached nail coil pouches, thereby allowing a worker to have ready access to a large quantity of nails within arm's reach.

It is a further object of this invention to provide a device which allows a worker to obtain a fresh coil of nails without the possibility of cutting one's fingers on the sharp end of the nails. Accordingly, the nail coil pouch is constructed so as to allow for grasping of the coil from its center through a slot which is present on the front surface of the nail coil pouch.

It is a further object of the invention to provide the user with a nail coil pouch which may be positioned by the user at an angle which is optimal for grasping the nail coil. Accordingly, the nail coil pouches are attached to the utility belt by a rivet which allows the pouch to be swiveled on the belt to an angle that proves most convenient for the worker.

It is a still further object that the invention is suitable for use during roofing and minimizes risk to the roofer caused by unnecessary trips made to replenish the supply of nails. Accordingly, several nail coil pouches are located on a single utility belt.

It is still a further object of the invention to provide a device which allows a worker to have within arm's reach other tools which are commonly used during a roofing job. Accordingly, this device also allows the belt to be selectively equipped with a pencil holder pouch, a utility knife holder pouch, or a hammer holder, if deemed necessary by the worker.

It is an even still further object of the invention to provide a utility belt which may be unencumbered by tools not necessary for a particular job. Accordingly, the utility knife holder pouch, pencil holder pouch, and hammer holder are selectively removable. In particular, these aforementioned holders are selectively disengaged from the belt by peeling the fastening material on the holder from the opposing fastening material on the rear surface of the belt, and then by lifting the holder upward so as to disengage its associated hook from the upper portion of the belt.

It is yet a further object of this invention to provide a worker with easy access to the various holders, irregardless of whether he/she is right-handed or left-handed. Accordingly, the user may freely position the various holders on either the right or left side of the belt, as desired by the user.

It is a still further object of this invention that the entire belt assembly be easily detached or attached to the waist of the user when necessary. Accordingly, the ends of the belt are attached to each other by a quick-release buckle and can be snapped on or off within seconds.

The invention is a nail coil and tool holding assembly, having a belt having a front surface and a rear surface, a plurality of nail coil pouches each having a front and a rear, wherein the rear of each pouch is attached to the front surface of the belt. Fastening material is attached to the rear surface of the belt for selectively allowing a hammer holder, a utility knife holder pouch, and a pencil holder pouch to be attached to the belt. The nail coil pouches are each pivotally attached onto the belt by a single rivet so that they may be rotated on the rivet to maximize ease of access to the nails. Each nail coil pouch has a top lip, is open thereat, and has a vertical slot on the front surface, extending downward from the top lip, to further facilitate easy access to the nails. Furthermore, the nail coils may be positioned in the nail coil pouch so that the points of the nails are oriented towards the pouch rear, thereby minimizing the possibility of a user being injured by the pointed end of a nail.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
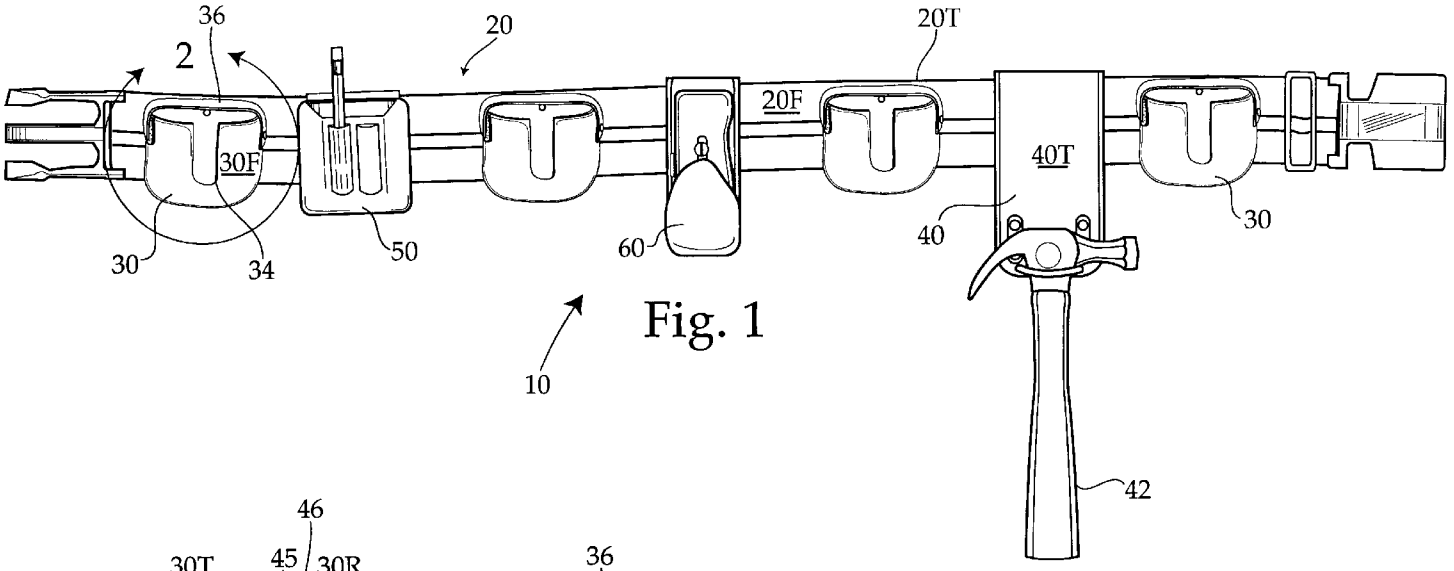
FIG. 1 is a front elevational view of the entire invention per se, showing the belt with the attached nail coil pouches, pencil holder pouch, utility knife holder pouch, and hammer holder.

FIG. 1 illustrates a nail coil and tool holder assembly 10, which comprises a belt 20, having a front surface 20F and a rear surface 20R, a plurality of nail coil pouches 30, a hammer holder 40, a pencil holder pouch 50, and a utility knife holder pouch 60.

Figure 2B:
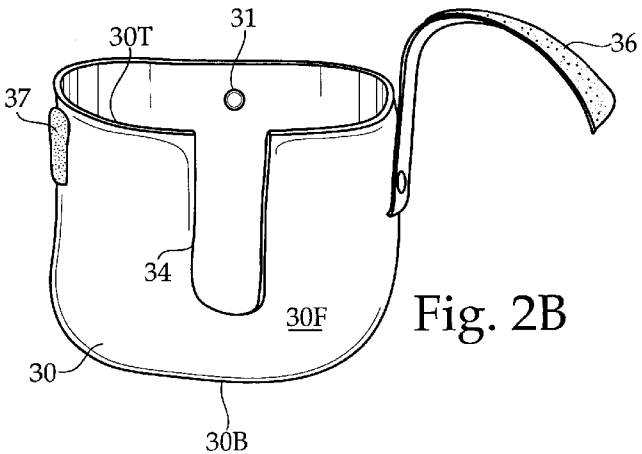
FIG. 2B is an enlarged perspective view of the nail coil pouch, taken generally in the area of circle 2 in FIG. 1.
Figure 2A:
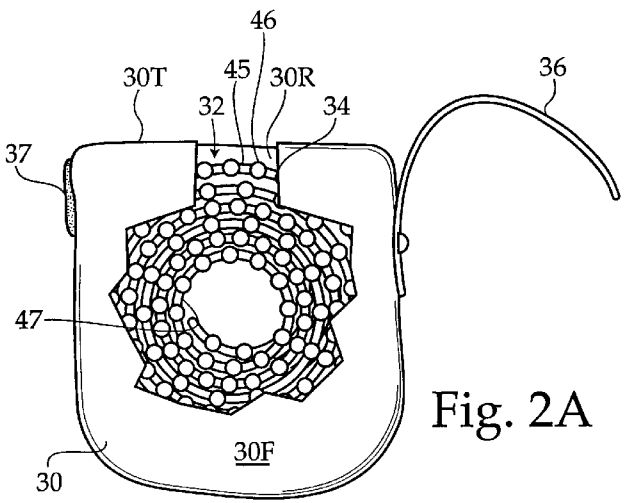
FIG. 2A is an enlarged front elevational view of the nail coil pouch with parts broken away, showing contained therein a coil of nails taken generally in the area of circle 2 in FIG. 1.

Referring momentarily to FIG. 2A, taken generally in the area of circle 2 in FIG. 1, the nail coil pouch 30 has a front surface 30F, a rear surface 30R, a top lip 30T, wherein the pouch 30 is open at the top lip 30T. A slot 34 extends vertically downward in the front surface 30F from the top lip 30T. In FIG. 2A, the nail coil pouch 30 is shown with a nail coil 32 being held within the nail coil pouch 30. The nail coil 32 comprises a plurality of nails 46 all extending parallel to each other, evenly spaced along and connected by a linear carrier 45, and rolled into a spiral having a central void 47. Some of the nails 46 are visible through the slot 34. The nails 46 conventionally have a point on one end and a head on an opposite end. Preferably, as illustrated, the nails are positioned so that the points are oriented toward the pouch rear surface 30R. Accordingly, even the nails 46 which are exposed through the slot 34 cannot harm the user. The present invention therefore allows the nail coils 32 to be stored in the pouch 30 until needed, and then retrieved by inserting one's fingers through the slot 34 in the pouch front surface 30F into the central void 47 of the nail coil, lifting the nail coil 32 upward, and removing the nail coil at the top lip 30T.

The pouch has a strap 36 which may be looped over the top lip 30T and secured to an attachment point 37 on the opposite side of the top lip 30T of the nail coil pouch 30 to prevent the nail coil 32 from inadvertently falling out of the nail coil pouch 30 during the activities of the worker.

FIG. 2B illustrates a perspective view of the nail coil pouch 30, also taken generally in the area of circle 2 of FIG. 1. The nail coil pouch 30 is shown empty, for clarity. The slot 34 on its front surface 30F allows for easy access to the nails in the nail coil 32. FIG. 2B also indicates the position of the rivet 31 which attaches the nail coil pouch 30 to the front surface 20F of the utility belt 20, and which allows the nail coil pouch 30 to be rotated with respect to the utility belt 20, thereby allowing easy access to the nail coil 32.

Figure 3:
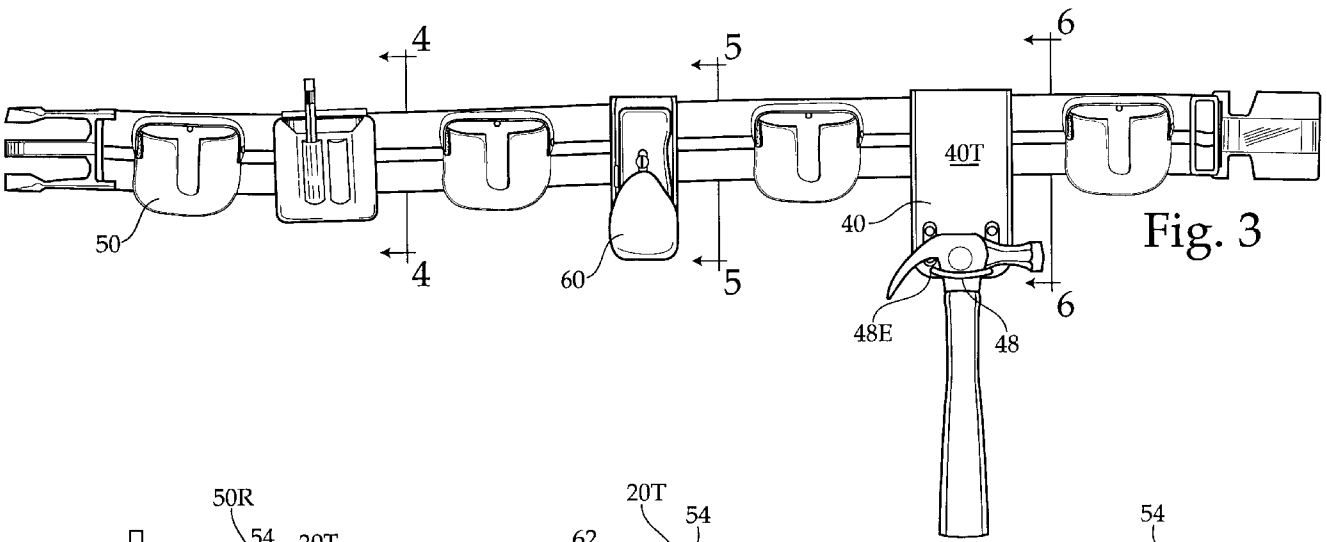
FIG. 3 is a front elevational view of the invention.
Figure 6:
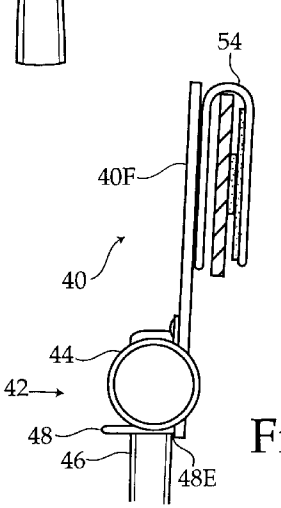
FIG. 6 is an enlarged cross-sectional view which shows attachment of the belt and the hammer holder, taken generally in the direction of line 6—6 in FIG. 3.
Figure 5:
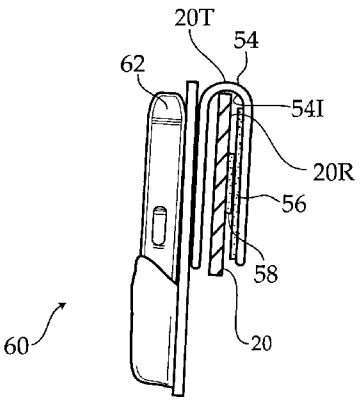
FIG. 5 is an enlarged cross-sectional view which shows attachment of the belt and the utility knife holder pouch, taken generally in the direction of line 5—5 in FIG. 3.
Figure 4:
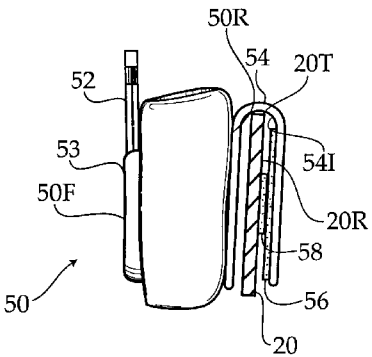
FIG. 4 is an enlarged cross-sectional view which shows attachment of the belt and the pencil holder pouch, taken generally in the direction of line 4—4 in FIG. 3.

FIG. 3 illustrates a front elevational view of the invention 10, with arrows indicating the position of the cross-sectional views shown in FIG. 4, FIG. 5, and FIG. 6.

FIG. 4, FIG. 5, and FIG. 6 illustrate cross-sectional views which show attachment of the belt and the pencil holder pouch 50, the utility knife holder pouch 60, and the hammer holder 40, respectively. Each of these holders is attached to an area of the belt which has fastening material 58 sewn into it.

Figure 7:
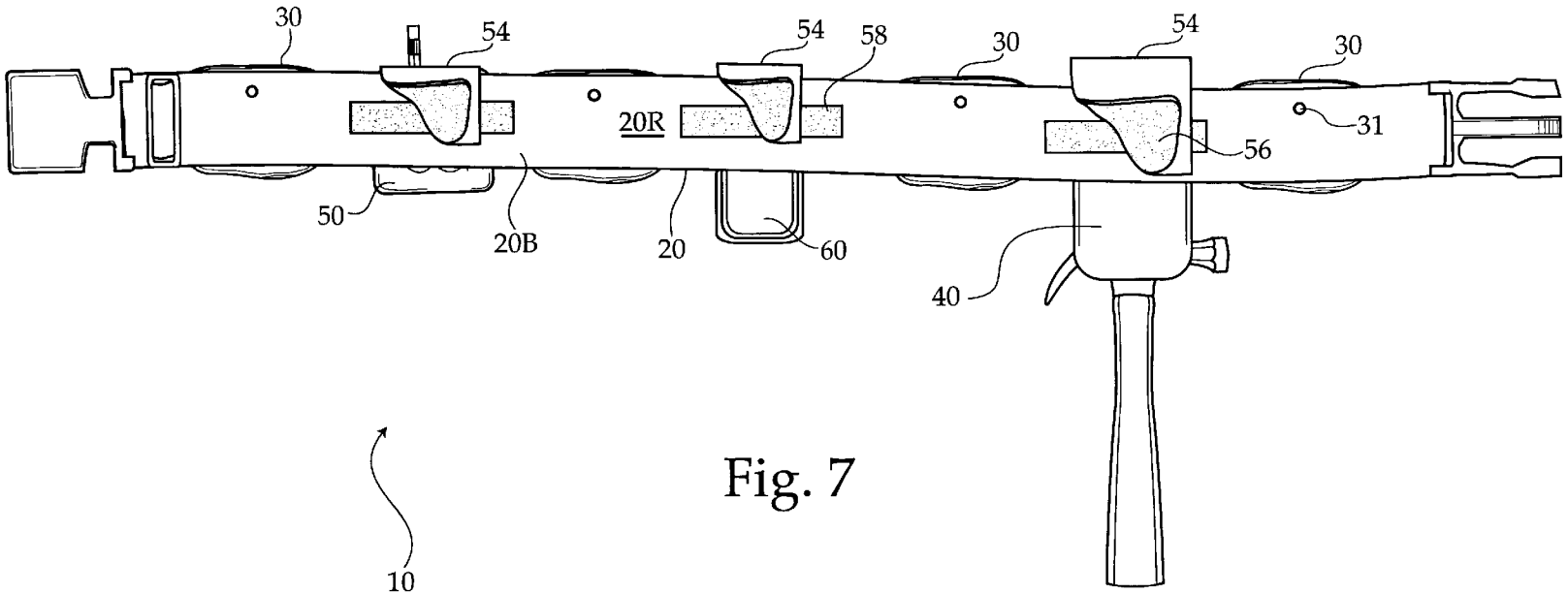
FIG. 7 is a rear elevational view of the rear surface of the invention, showing the belt with attached nail coil pouch, pencil holder pouch, utility knife holder pouch, and hammer holder.

Referring momentarily to FIG. 7, the belt rear surface 20R has a plurality of strips of fastening material 58 to facilitate attachment of the various holders. FIG. 4 illustrates a cross-sectional view which shows attachment of the utility belt 20 and the pencil holder pouch 50, having a front surface 50F and a rear surface 50R, taken generally in the direction of line 4—4 in FIG. 3. A pencil 52 is held in the pencil holding slot 53 located towards the front surface 50F of the pencil holder pouch 50. A hook 54 is attached to the rear surface 50R of the pencil holder pouch 50. The hook 54 has an inside surface 54I. As illustrated, the hook has a strip of fastening material 56 attached to its inside surface 54I. Accordingly, the pencil holder pouch 50 is attached to the utility belt 20 by fitting the hook 54 over the top surface 20T of the utility belt 20, thereby causing the strip of fastening material 56 on the hook 54 to secure to the fastening material 58 located on the rear surface 20R of the utility belt 20.

FIG. 5 illustrates a cross-sectional view which shows attachment of the utility belt 20 and the utility knife holder pouch 60, taken generally in the direction of line 5—5 in FIG. 3. The mode of attachment of the utility knife holder pouch 60 to the utility belt 20 is the same as that of the pencil holder pouch 50, as described in the preceding paragraph. A utility knife 62 is shown as being held by the utility knife holder 60.

FIG. 6 illustrates a cross-sectional view which shows attachment of the utility belt 20 and the hammer holder 40, having a front surface 40F and a rear surface 40R, while it is holding a hammer 42, taken generally in the direction of line 6—6 in FIG. 3. The hammer holder 40 has a semicircular loop of metal 48, having a pair of ends 40E. The loop of metal 48 is horizontally oriented and attached at both of its ends 48E to the front surface 40F of the hammer holder 40. A hammer 42, having a head portion 44 and a handle portion 46, is being supported by the hammer holder 40. The head portion 44 of the hammer 42 rests on the loop of metal 48 located on the front surface 40F of the hammer holder 40. The mode of attachment of the hammer holder 40 to the utility belt 20 is the same as the mode of attachment of the pencil holder pouch 50 as described above.

FIG. 7 once again indicates a rear elevational view of the invention, showing the three nail coil pouches 30, the pencil holder pouch 50, the utility knife holder pouch 60, and the hammer holder 40, attached to the utility belt 20. Fastening material 58 extends on the rear surface 20R of the utility belt 20 to facilitate attachment of the pencil holder pouch 50, the utility knife holder pouch 60, and the hammer holder 40. The fastening material 58 may extend along a substantial portion of the rear surface 20R of the utility belt 20. However, the fastening material 58 need not extend immediately behind the nail coil pouches 30, accordingly, discrete strips are illustrated. As described above, each holder is equipped with a hook 54 at its rear surface. The hooks 54 each have an inner surface 54I. Fastening material 56 is attached to this inner surface 54I. In FIG. 7, the hooks 54 are shown being peeled back to reveal the fastening material 56. However, the hooks 54 are preferably rigid, and are thus incapable of actually being peeled back in this fashion.

In conclusion, herein is presented a nail coil and tool holding assembly, which has a utility belt and a plurality of attached nail coil pouches. A utility knife holder pouch, a pencil holder pouch, and hammer holder may be selectively attached. The invention is illustrated by example in the drawing figures, and throughout the written description. It should be understood that numerous variations are possible, while adhering to the inventive concept. Such variations are contemplated as being a part of the present invention.

What is claimed is:

1. A nail coil and tool holding assembly, for use by a worker, in holding nail coils having a plurality of nails which extend parallel to each other and are evenly spaced along and connected by a linear carrier, and rolled into a spiral having a central void, each nail having a point on one end, comprising:

a utility belt having two ends, and a front and a rear surface, whereby the ends of the belt are selectively attached to each other to secure the belt around the worker; and a plurality of nail coil pouches which are attached to the utility belt, wherein each nail coil pouch is sized to accommodate a nail coil, each nail coil pouch having a front surface, a rear surface, two sides, a top lip and a bottom portion, wherein the nail coil pouch is open at the top lip, and closed at the bottom portion, and has a slot extending vertically downward in the front surface from the top lip, such that when the nail coil is within the pouch, the slot provides access to the central void of the nail coil so that the nail coil can be lifted out from the top lip by lifting the nail coil by the central void.

2. The nail coil and tool holding assembly, as recited in claim 1, further comprising fastening material attached to the belt, and a plurality of holders, each holder having a front and a rear portion, the holders comprising a pencil holder pouch, a utility knife holder pouch, and a hammer holder, the belt and each holder also have fastening material, thereby allowing selective attachment of said holders to the belt by means of mating the fastening material on the holder with the fastening material on the belt.

3. The nail coil and tool holding assembly, as recited in claim 2, wherein the fastening material on the belt is attached to the rear surface of the belt, wherein the holders each have a hook attached to its rear portion constructed of a rigid material, each hook having an inside surface and an outside surface, with fastening material attached to the inside surface of the hook, thereby enabling attachment of the holder to the belt, by mating the fastening material located on the inside surface of the hook with the fastening material attached to the rear surface of the belt.

4. The nail coil and tool holding assembly, as recited in claim 1, wherein each nail coil pouch has a rivet which attaches the rear surface of said nail coil pouch to the belt, thereby allowing the nail coil pouch to swivel on the belt, for ease of access to the nail coil selectively contained therein.

5. The nail coil and tool holding assembly as recited in claim 4, wherein each nail coil pouch has a strap with two ends, one of said ends is attached to one of the sides of the nail coil pouch, near its top lip, and the other end being selectively attachable to the other side of the nail coil pouch near the top lip, for selectively maintaining the nail coil within the nail coil pouch.

6. A method of replenishing a supply of nails from a utility belt worn by a user with an attached nail coil pouch, each nail coil pouch capable of holding a nail coil having a plurality of nails each having a pointed end, and where the nails are attached to each other by a carrier and positioned in the nail coil pouch such that the points of the nails in the nail coil are oriented toward the pouch rear, each nail coil pouch further having a front surface, a rear surface, two sides, a top lip and a bottom portion, wherein the nail coil pouch is open at the top lip, and closed at the bottom portion, the nail coil pouch having a slot extending vertically downward in the front surface from the top lip, comprising the steps of:

storing a nail coil within the nail coil pouch;

inserting the user's fingers through the slot in the front surface of the pouch into the central void of the nail coil;

lifting the nail coil upward; and removing the nail coil at the top lip of the nail coil pouch.

7. The method of replenishing a supply of nails from a utility belt as recited in claim 6, wherein each nail coil pouch is attached to the utility belt by a single rivet in the rear surface of the nail coil pouch, and wherein the step of inserting the user's fingers through the slot is preceded by the step of swiveling the nail coil pouch on the belt to maximize ease of access to the nail coil contained therein.

8. The method of replenishing a supply of nails from a utility belt as recited in claim 7, wherein each nail coil pouch has a strap located on one side of the upper lip which may be attached to the opposing side of the upper lip to hold the nail coil in place, wherein the step of storing a nail coil within the nail coil pouch includes fastening the strap across the nail coil pouch, and wherein the step of inserting the user's fingers through the slot in the front surface of the pouch is preceded by the step of disengaging the strap attached across the nail coil pouch.

* * * * *